US007640775B2

(12) United States Patent
Durney

(10) Patent No.: US 7,640,775 B2
(45) Date of Patent: Jan. 5, 2010

(54) APPARATUS AND METHOD FOR JOINING THE EDGES OF FOLDED SHEET MATERIAL TO FORM THREE-DIMENSIONAL STRUCTURE

(75) Inventor: Max W. Durney, San Francisco, CA (US)

(73) Assignee: Industrial Origami, Inc., San Francisco, CA (US)

( * ) Notice: Subject to any disclaimer, the term of this patent is extended or adjusted under 35 U.S.C. 154(b) by 499 days.

(21) Appl. No.: 11/357,934

(22) Filed: Feb. 16, 2006

(65) Prior Publication Data

US 2006/0261139 A1 Nov. 23, 2006

Related U.S. Application Data

(63) Continuation-in-part of application No. 10/795,077, filed on Mar. 3, 2004, now Pat. No. 7,152,450, which is a continuation-in-part of application No. 10/672,766, filed on Sep. 26, 2003, now Pat. No. 7,152,449, which is a continuation-in-part of application No. 10/256,870, filed on Sep. 26, 2002, now Pat. No. 6,877,349, which is a continuation-in-part of application No. 09/640,267, filed on Aug. 17, 2000, now Pat. No. 6,481,259.

(60) Provisional application No. 60/654,545, filed on Feb. 17, 2005.

(51) Int. Cl.
*B21D 43/28* (2006.01)
*B31B 1/50* (2006.01)

(52) U.S. Cl. ..... 72/324; 493/137

(58) Field of Classification Search ..... 72/324; 493/136–140; 428/571, 582, 596–598, 603; 206/756, 766, 214, 449; 283/56, 61, 62; 281/2, 5; 40/661.08, 539, 786, 788
See application file for complete search history.

(56) References Cited

U.S. PATENT DOCUMENTS 387,651 A 8/1888 Maxim
624,144 A 5/1899 Wilmot
975,121 A * 11/1910 Carter ..... 206/521

(Continued)

FOREIGN PATENT DOCUMENTS

DE 298 18 909 U1 2/1999

(Continued)

*Primary Examiner*—Dana Ross
*Assistant Examiner*—Teresa M Bonk
(74) *Attorney, Agent, or Firm*—Morgan, Lewis & Bockius LLP; David J. Brezner; Victor E. Johnson

(57) ABSTRACT

A sheet of material formed for folding into a three-dimensional structure. The sheet has edges formed with joinder structures, such as dovetails, and a plurality of folding structures, such as slits, grooves or displacements, that control folding of the sheet in a manner causing the joinder structures to be folded into interlocking interengagement. The folding structures are configured for very precise folding of the sheet so that the folding structures will be in precise registered juxtaposition. Additionally, the sheet of material includes a retention structure, such as a retention fold or a retention deformation, which will prevent unfolding of the sheet. A method for fastener-free joining of sheet edges together also is disclosed, as are the resulting three-dimensional structures.

14 Claims, 5 Drawing Sheets

U.S. PATENT DOCUMENTS

| | | | | |
|---|---|---|---|---|
| 2,901,155 | A | 8/1959 | Vines | |
| 2,976,747 | A | 3/1961 | Schatzschock et al. | |
| 3,626,604 | A | 12/1971 | Pierce | |
| 3,666,607 | A | 5/1972 | Weissman | |
| 3,756,499 | A | 9/1973 | Giebel et al. | |
| 3,963,170 | A | 6/1976 | Wood | |
| 4,190,190 | A | 2/1980 | Halonen | |
| 4,289,290 | A | 9/1981 | Miller | |
| 4,628,661 | A | 12/1986 | St. Louis | |
| 4,792,082 | A | 12/1988 | Williamson | |
| 4,819,792 | A * | 4/1989 | Christian | 206/45.25 |
| 5,225,799 | A | 7/1993 | West et al. | |
| 5,239,741 | A | 8/1993 | Shamos | |
| 5,568,680 | A | 10/1996 | Parker | |
| 5,660,365 | A | 8/1997 | Glick | |
| 5,692,672 | A | 12/1997 | Hunt | |
| 6,158,652 | A | 12/2000 | Ruiz et al. | |
| 6,210,037 | B1 | 4/2001 | Brandon, Jr. | |
| 6,481,259 | B1 | 11/2002 | Durney | |
| 6,640,605 | B2 | 11/2003 | Gitlin et al. | |
| 6,877,349 | B2 | 4/2005 | Durney et al. | |
| 7,032,426 | B2 | 4/2006 | Durney et al. | |
| 7,152,449 | B2 | 12/2006 | Durney | |
| 7,152,450 | B2 | 12/2006 | Durney et al. | |
| 7,263,869 | B2 | 9/2007 | Durney et al. | |
| 7,350,390 | B2 | 4/2008 | Durney et al. | |
| 2001/0010167 | A1 | 8/2001 | Leek | |
| 2003/0037586 | A1 | 2/2003 | Durney et al. | |
| 2005/0064138 | A1 | 3/2005 | Durney et al. | |
| 2006/0021413 | A1 | 2/2006 | Durney et al. | |
| 2006/0075798 | A1 | 4/2006 | Durney et al. | |
| 2006/0277965 | A1 | 12/2006 | Durney | |
| 2007/0113614 | A1 | 5/2007 | Durney et al. | |
| 2007/0123113 | A1 | 5/2007 | Durney | |
| 2007/0231062 | A1 | 10/2007 | Durney | |
| 2008/0048366 | A1 | 2/2008 | Durney | |

FOREIGN PATENT DOCUMENTS

| | | |
|---|---|---|
| GB | 2 129 339 A | 5/1984 |
| JP | 02-065416 U | 5/1990 |
| JP | 02-165817 | 6/1990 |

* cited by examiner

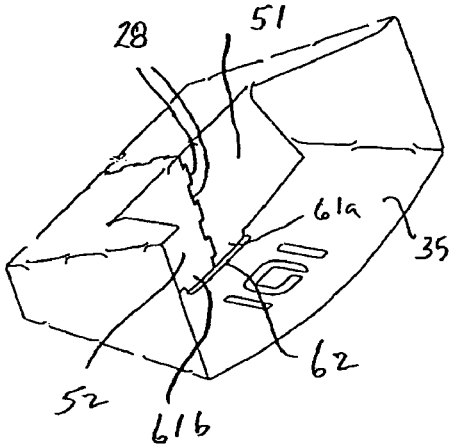
FIG.__8
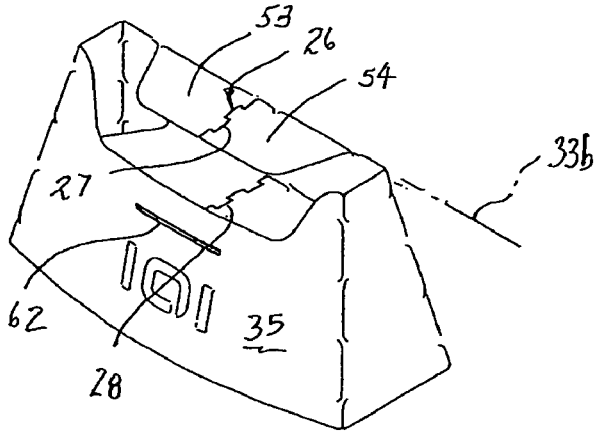
FIG.__9
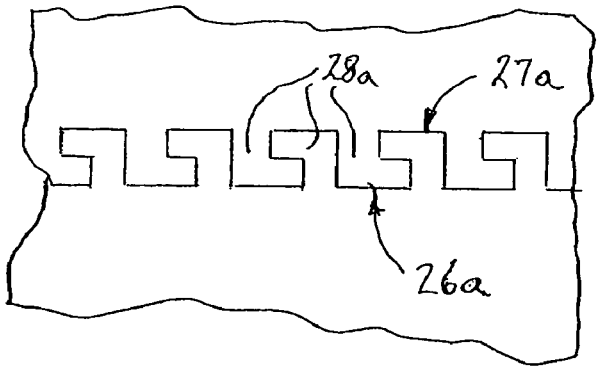
FIG.__10

APPARATUS AND METHOD FOR JOINING THE EDGES OF FOLDED SHEET MATERIAL TO FORM THREE-DIMENSIONAL STRUCTURE

RELATED APPLICATIONS

This application claims priority to U.S. Provisional Patent Application No. 60/654,545 filed Feb. 17, 2005 and entitled APPARATUS AND METHOD FOR JOINING THE EDGES OF FOLDED SHEET MATERIAL TO FORM THREE-DIMENSIONAL STRUCTURES, the entire contents of which is incorporated herein by this reference.

This application is also a Continuation-in-Part of U.S. Ser. No. 10/795,077 filed Mar. 3, 2004 and entitled SHEET MATERIAL WITH BEND CONTROLLING DISPLACEMENTS AND METHOD FOR FORMING THE SAME and published as U.S. Patent Application Publication No. US 2004/0206152 A1, which is a Continuation-in-Part of U.S. Ser. No. 10/672,766 filed Sep. 26, 2003 and entitled TECHNIQUES FOR DESIGNING AND MANUFACTURING PRECISION-FOLDED, HIGH STRENGTH, FATIGUE-RESISTANT STRUCTURES AND SHEET THEREFOR and published as U.S. Patent Application Publication No. US2004/0134250A1, which is a Continuation-in-Part of U.S. Ser. No. 10/256,870 filed Sep. 26, 2002 and entitled METHOD FOR PRECISION BENDING OF SHEET MATERIALS, SLIT SHEET AND FABRICATION PROCESS and now U.S. Pat. No. 6,877,349, which is a Continuation-in-Part of U.S. Ser. No. 09/640,267 filed Aug. 17, 2000 and entitled METHOD FOR PRECISION BENDING OF A SHEET OF MATERIAL AND SLIT SHEET THEREFOR and now U.S. Pat. No. 6,481,259, the entire contents of which applications and patents is incorporated herein by this reference.

TECHNICAL FIELD

The present invention relates, in general, to apparatus and methods for joining together the edges of sheet material which has been folded so as to form three-dimensional structures, and more particularly, relates to apparatus and methods for joining sheet material which has been folded using high-precision folding structures capable of accurately registering joinder structures for coupling together of sheet edges.

BACKGROUND ART

The Related Applications set forth above, and incorporated herein by reference, set forth in considerable detail apparatus and methods for bending or folding sheet material to form three-dimensional structures. Flat sheets are provided with a plurality of folding structures which will produce folding of the sheets along fold lines that can very precisely be controlled. The folding structures are typically slits, grooves or displacements that are positioned on alternating sides of a desired fold line so as to define spaced-apart bending or folding straps that precisely control folding of the sheet. Most preferably, the folding structures also produce edge-to-face engagement of the sheet material on opposite sides of the folding structures to further enhance folding precision and structural strength.

The folded sheets of the Related Applications often have been used to produce three-dimensional structures in which free or adjacent edges of the sheets are folded into abutting or overlapping relation and then are joined together to stabilize the resulting structure against unfolding. The previous techniques for securing the edges of the folded sheets together have varied considerably, depending upon the application, but in many instances the sheet edges have merely been joined together using standard fasteners such as screws, rivets, other mechanical fasteners, and/or welding, brazing or adhesives.

One of the very substantial advantages of the apparatus and method of the Related Applications is the ability to fold sheet material with both great precision and complexity using low folding forces. Precise and complex folding of sheet material allows techniques for joining the edges of the sheet material to be based upon precise registration of the edges at the end of the folding process so that joinder structures provided at, or proximate to the edges can be folded into registration with each other for the purpose of coupling the joinder structure together against separation of the edges.

The complexity with which sheets can be folded using the techniques set forth in the Related Applications allows a great reduction in the number of separate parts required to create a structure. Further reducing the number of parts by eliminating separate mechanical fasteners, therefore, is highly desirable, and elimination of separate welding, soldering and adhesive bonding steps also reduces the cost associated with the finished part.

Moreover, the precise sheet folding systems of the Related Applications can be applied to a wide range of sheet thicknesses. Thus, fastener-free sheet edge joining should also be capable of being used in applications requiring high strength joinder of the sheet edges.

What is needed is an apparatus and method to employ the ability to precisely fold sheet material in a manner which will allow fastener-free, high strength, low cost joinder of edges of the sheet material.

What is needed is an apparatus and method to provide an apparatus and method for forming enclosures or housings for various purposes, including the enclosure of electrical components, which apparatus and method lend themselves to efficient and low-cost manufacturing processes.

The apparatus and method of the present invention have other objects and features of advantage which will become apparent from, or are set forth in more detail in, the accompanying drawing and Detailed Description Of The Invention.

BRIEF SUMMARY OF THE INVENTION

In one aspect, the present invention includes a sheet of material formed for bending or folding into a three-dimensional structure which includes, briefly, a sheet having edges and joinder structures proximate the edges formed to join the edges together; a plurality of shape-controlling folding structures formed in the sheet of material along a plurality of desired fold lines, the folding structures being positioned to enable folding of the sheet of material into a three-dimensional structure of a desired shape and the shape-controlling folding structures being configured to cause the joinder structures proximate the sheet edges to be positioned together in registration for joining when the sheet material is folded; and the sheet material being further formed with at least one retention structure formed to retain the joinder structures and edges together.

Most preferably, the joinder structures are provided by shaping the edges of the sheet with mating configurations, such as dovetails, which can be interlocked together against separation by the retention structure. In one embodiment, the retention structure is provided by a plurality of retention folding slits, grooves or displacements that are positioned to produce folding of the sheet material out of the plane of the joinder structures. In an alternate embodiment, the retention structure is provided by a resiliently displaceable deformation or bend which biases the joinder structures together against separation.

In another aspect of the invention, the three-dimensional object or structure formed from a sheet of material having shape-controlling folding structures, edge joining structures and retention structures is provided.

A method of fastening edges of a sheet of material together to form a three-dimensional structure is also provided and includes, briefly, the steps of: folding the sheet of material along a plurality of shape-controlling fold lines, the fold lines being controlled by a plurality of shape-controlling structures provided in the sheet of material which are adapted to cause sufficiently precise folding along the fold lines that two edges of the sheet of material are positioned in precise registered juxtaposition for fastening together; and the step of fastening the juxtaposed edges together to prevent unfolding of the three-dimensional structure.

In a further aspect, a method of assembling a plurality of components into a plurality of folded enclosures also is provided which includes the steps of: forming a sheet of material with a plurality of enclosure blanks attached in side-by-side relation to the sheet of material, with each enclosure blank having a plurality of shape-controlling folding structures formed therein and having a plurality of joinder structures formed in at least two edges of the blank. The folding structures are positioned to enable folding of the enclosure blanks into a three-dimensional enclosures with the joinder structures on the two edges being positioned together in registered relation for coupling together. The enclosure blanks also each further include a retention structures to hold the joinder structures in place against separation. The method further includes the steps of: folding each enclosure blank up out of the plane of the sheet, while still attached to the sheet of material to produce a partially formed enclosure blank; mounting a component into each of the partially formed enclosure blanks; thereafter folding the enclosure blank further while attached to the sheet of material to encircle a portion of the component and to position the joinder structures of the enclosure blank in registration for coupling together; coupling the joinder structures together; securing the joinder structures using the retention structures; and detaching the enclosures with the components therein from the sheet of material.

DESCRIPTION OF THE DRAWING

FIGS. 4-9 are perspective views illustrating folding of the sheet of material from a flat sheet of FIG. 3 to the three-dimensional card holder, as shown in FIG. 1.

FIG. 10 is a fragmentary, top plan view of modified edge joining structures of the present invention.

DETAILED DESCRIPTION OF THE INVENTION

Reference will now be made in detail to the preferred embodiments of the invention, examples of which are illustrated in the accompanying drawings. While the invention will be described in connection with the preferred embodiments, it will be understood that they are not intended to limit the invention to those embodiments. On the contrary, the invention is intended to cover alternatives, modifications and equivalents which may be included within the spirit and scope of the invention, as defined by the appended claims.

The apparatus and method of the present invention for joining together edges of sheet material which has been folded into a three-dimensional object or structure can be employed in a wide range of applications. In FIGS. 1-9, a business card holder is illustrated because it is a good example of the complexity of precise folding which is achievable using the apparatus and methods of the Related Applications. This precision and capacity for complexity lends itself particularly well to new solutions for joining the edges of the folded sheets together, either with or without fasteners. The cardholder of FIGS. 1-9 is not designed to withstand substantial loading forces, as would be, for example, a box beam, but cardholders constructed as shown in the present drawings have been made out of folded stainless steel sheet material having a thickness dimension of 0.046 inches. The same edge joining structures and processes employed for the described cardholder are equally as applicable to load bearing three-dimensional structures and to sheet material of greater or lesser thickness, as well as to joining the edges of other metal and non-metallic sheet material.

Figure 1:
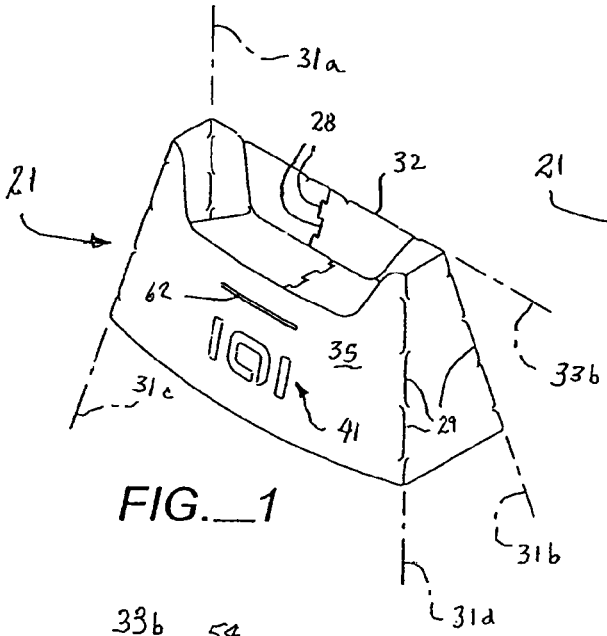
FIG. 1 is a top perspective view of a business card holder constructed in accordance with the present invention.
Figure 2:
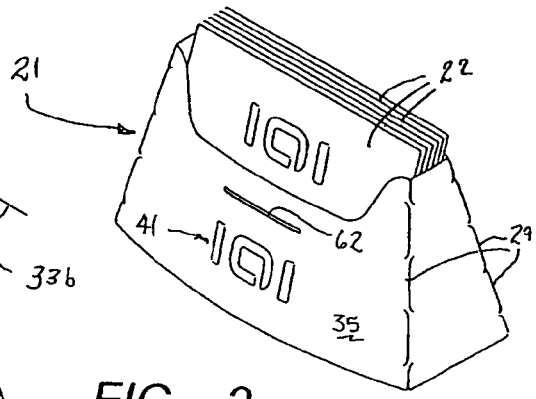
FIG. 2 is a top perspective view of the business card holder of FIG. 1 with business cards placed in the holder.
Figure 3:
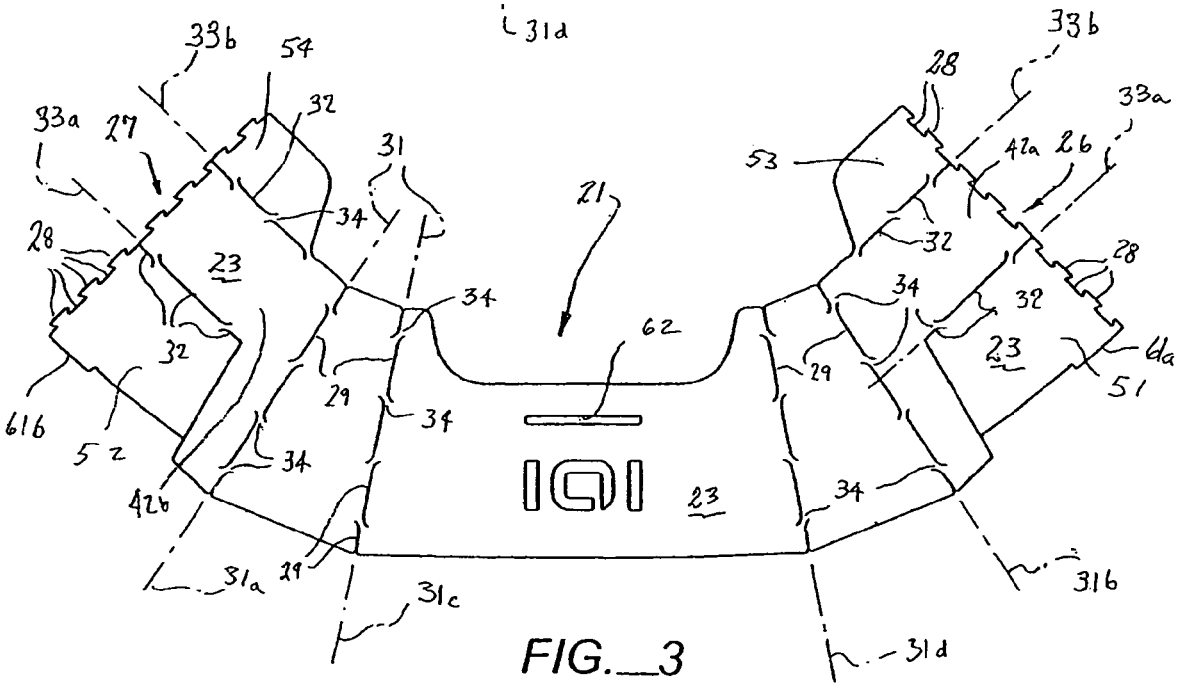
FIG. 3 is a top plan view of the sheet of material formed in accordance with the present invention to produce the card holder of FIG. 1.

Turning to FIGS. 1 and 2, a business card holder, generally designated 21, is shown which has been folded from a piece of flat sheet material and is ready for use. In FIG. 2, a plurality of business cards 22 are held by cardholder 21, as it would normally be used. Cardholder 21 has been folded from a flat sheet of material or cardholder blank 23, in this case a stainless steel blank, which sheet is shown in FIG. 3. Once folded up into the three-dimensional structure of FIGS. 1 and 2, the sheet has been secured along edges, as will be described in more detail hereinafter, against unfolding.

Sheet 23 is shown in FIG. 3 as it would be typically formed out of a much larger sheet, for example, by laser cutting, water jet cutting, punching, stamping and/or other suitable means. Typically, a plurality of cardholder sheets 23 are laid out in relatively nested relation to minimize scrap and then are cut from the larger sheet, for example, by a CNC controlled laser cutter. Cardholder 21 is then formed by folding cardholder blank 23, as will be described.

In FIG. 3 a generally U-shaped cardholder blank 23 is shown which has free edges 26 and 27 that have been formed with joinder structures 28, in this case dovetail configurations. One will appreciate that other joinder structures may also be employed. Joinder structures 28 are formed in a manner which will allow the spaced-apart free edges 26 and 27 to eventually be joined together into the three-dimensional object of FIGS. 1 and 2. Cardholder blank 23 has edges 26 and 27 which are to be joined and are spaced apart from each other when the sheet material is in the flat condition of FIG. 3. The edge joining techniques of the present invention also can be used, however, to join edges which are contiguous or abutting relation when sheet 23 is in the flat condition, for example, edges oriented at 90 degrees to each other and touching at an apex. Such edge configurations often are employed in corner structures.

Additionally, cardholder 21 is a form of enclosure or continuous peripheral wall in which one edge 26 of the blank is folded around to produce a continuous wall which is joined to the other edge 27. The three-dimensioned structure produced and joined into a stable structure by the edge joining apparatus and method of the present invention does not have to be an enclosure or to have a continuous wall which encircles a central space, but such structures are particularly advantageously formed by the present invention.

The flat sheet or cardholder blank 23 also includes a plurality of shaped-controlling folding structures 29 formed in the sheet of material along a plurality of desired fold lines 31*a*, 31*b*, 31*c* and 31*d* which will cause the sheet of material to be folded into a desired three-dimensional shape in which sheet edges 26 and 27 will be positioned in juxtaposed registered relation. This folding process will be described in greater detail in connection with FIGS. 4-9.

Sheet 23 is further provided with at least one retention structure formed to retain the joinder structures 28 together against separation. In the embodiment shown in FIG. 3, the retention structures 32 are in the form of folds or bends along retention fold lines 33*a* and 33*b* that secure the folded cardholder blank against unfolding.

The shape-controlling folding structures 29 and the retention folding structures 32 are both preferably constructed in the same manner. These folding structures are provided as described in the Related Applications, and they are formed in a manner which will result in very precise folding of sheet material 23 along the desired fold lines. These folding structures can take the form of slits, grooves or displacements formed in cardholder blank 23, and they define folding straps 34 between longitudinally adjacent fold inducing structures 29 and 32. Folding straps 34 between the slits, grooves or displacements have center lines which extend obliquely across folding lines 31*a*-31*d* and 33*a*-33*b* so as to precisely control folding of sheet blanks 23. In the most preferred form, the folding structures are formed with a kerf or width dimension that ensures that the sheet material on opposite sides of folding structures 29 and 32 will engage in edge-to-face engagement during folding for greater precision of folding, when combined with the precision achieved by using oblique folding straps 34. The principles which control precise sheet material folding are set forth in more detail, for example, in application U.S. patent application Ser. No. 10/256,870, identified more fully in the Related Application section of this application.

Figure 4:
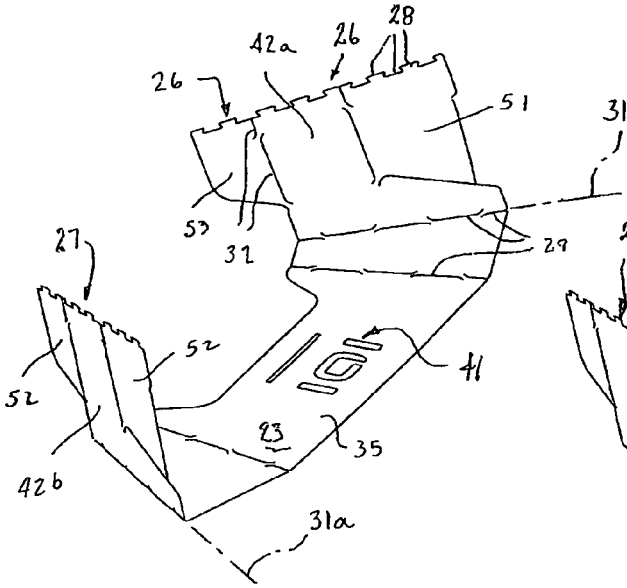

Referring now to FIGS. 4-9, folding of cardholder blank 23 into the three-dimensional cardholder of FIGS. 1-2 can be described in more detail. In FIG. 4, cardholder blank or sheet 23 has been folded along fold lines 31*a* and 31*b* upwardly from the plane of the sheet in FIG. 3. Edges 26 and 27, with their joinder structures 28, are now in a near vertical orientation.

Figure 5:
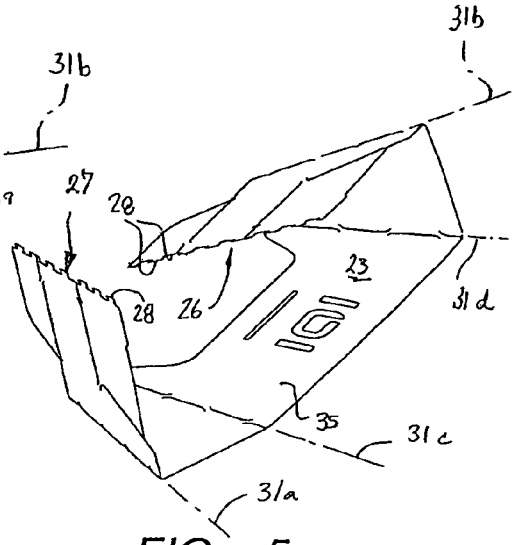

In FIG. 5, one side of blank 23 has been folded along fold line 31*d* to a near parallel orientation to the front panel 35, which bears an "IOI" standing for "Industrial Origami, Inc." The fold along fold line 31*d* of FIG. 5, therefore, starts to complete the enclosure which will result in edges 26 and 27 being juxtaposed, but edge 27 will be seen in FIG. 5 not to be in position for joinder to edge 26.

Figure 6:
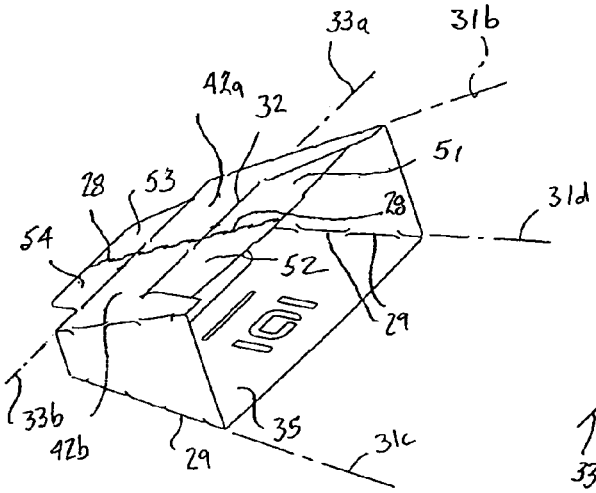
Figure 7:
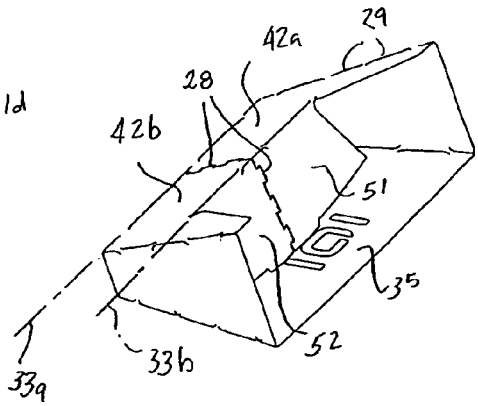

In FIG. 6, a fold along fold line 31*c* has been made so as to position edges 26 and 27 of the sheet in juxtaposed and registered relation with dovetail joinder structures 28 interengaged with each other so as to join what was the free edges of the sheet or blank 23 together.

Once back panel portions 42*a* and 42*b* have been folded together, they will be aligned in substantially the same plane, as will joinder dovetails 28 on edges 26 and 27. Such positioning of the dovetail joinder structures in the same plane allows edges 26 and 27 to be slightly displaced inwardly or outwardly of the common plane and then displaced back into the common plane of panels 42*a* and 42*b* for interlocking of the dovetails. As long as the dovetails remain in a common plane, they will not be separable, as is well know to those skilled in the art.

It is possible for back panels 42*a* and 42*b* to be oriented in slightly skewed planes and still stay interlocked, with the amount of skewing which is possible increasing as the thickness of the sheet of material and the dimensional tolerances of the dovetails are increased. In fact, as will be described below, both front panel 35 and back panels 42*a*, 42*b* are preferably bowed somewhat, from a common plane, which can be easily accommodated by the thickness of the sheet stock and even moderate differences in the dovetail dimensions.

It also should be noted that in the broadest aspect of the present invention, joinder structures 28 do not have to be formed for joining in substantially two dimensions, as are dovetails. Corner joinder structures can be provided, for example, in which the edge joinder structures prevent separation of the edges when folded together to produce a corner. A sheet retention structure must also be appropriately formed to prevent separation of the corner joinder structures from one another. Retention of the dovetails against separation is described below for joinder structures 28.

One advantage of the edge joinder method of the present invention is that the edges do not have to be overlapped, that is, the ends or edges of the sheet material are joined in end-to-end relation with the joined wall having the same thickness across the joined edges. For example, the edges of the sheet material lay "in-plane" with respect to one another and are not overlapped, that is, the edges do not lie one upon the other. This has both aesthetic and structural advantages for certain objects, such as, business card holders.

Edge joinder structures 28 are shown in the embodiment of FIGS. 1-9 as being substantially continuously extending along edges 26 and 27. It will be understood, however, that a single joinder structure 28 might be usable for joining edges in some structures, or intermittent, spaced-apart joinder structures 28 could be employed. For many structures, a continuous joint between edges 26 and 27 has strength, as well as aesthetic advantages.

At this point it also should be noted that FIGS. 1-9 do not show the thickness dimension of sheet or blank 23, and to that extent the drawings are schematic. In fact, sheet 23 will have a thickness dimension and when dovetail joinder structures 28 are interengaged as shown in FIG. 6, the thickness dimension of the sheet will prevent separation of both the dovetails and free edges 26 and 27, as above described.

The structure of FIG. 6, which is essentially an enclosure which could be part of a rectangular box beam, a tapered box beam or the like, could be subjected to shifting of edges 26 and 27 out of the substantially common plane 42*a*, 42*b*, with the result of possible disengagement of dovetail joinder structures 28. Folding structures 29, 32 have an advantage, in addition to precision of their folding, of being able to fold under relatively low folding forces. Thus, a stainless steel sheet can be folded along fold lines 31*a*-31*d* by hand. Juxtaposed free edges 26 and 27, therefore, also could become unfolded or even unfolded back to a flat sheet, as shown in FIG. 3. Thus, it is preferable that at least one retention structure be provided on blank 32 to essentially interlock dovetails 28 against disengagement. In the broadest sense that could be a panel (not shown) that folds across the joinder dovetails and is secured by a standard fastener such as a screw or rivet. This would increase the number of parts required for the cardholder, as well as creating an overlapping of walls.

In the embodiment shown in FIGS. 1-9, two retention fold lines 33*a* and 33*b* are used to interlock dovetails 28 against separation. As will be seen in FIG. 7, therefore, sheet flaps 51 and 52 have been folded down along fold line 33*a* to a position proximate front panel 35 bearing logo 41. In addition, blank flaps 53 and 54, which also are held together by dovetails 28, have been folded down about retention fold line 33*b*, as shown in FIG. 9. The retention folds, therefore, cause flaps 51-54 to be out of the common plane 42*a*, 42*b* of the back of the cardholder, and they thereby interlock the dovetails together against separation by virtue of flaps 53 and 54 limiting out-of-plane motion of common plane portions 42*a* and 42*b*.

The retention fold lines 33*a* and 33*b* result in folds which are extremely difficult for even the relatively easily folded sheet material to unfold back thereby reducing the possibility that the dovetails will become disengaged.

In order to further enhance the interlocking of dovetail joinder structures 28, however, a keeper assembly further can be provided in cardholder blank 23 which is adapted to resist unfolding of the sheet material along the retention fold lines. In the embodiment of FIGS. 1-9, the keeper assembly is comprised of a tab and a mating slot. In this case the tab takes the form of a first tab 61*a* on panel 51 and a second tab 61*b* on panel 52, as shown in FIG. 1, that are dimensioned to be inserted into a slot 62 in front panel 35 of sheet 23. The insertion of tabs 61*a* and 61*b* into slot 62 can best be seen in FIG. 8. Thus, the slot and tab keeper assembly prevents panels 51 and 52 from unfolding along retention fold line 33*a*. Most preferably the length dimension between fold line 33*a* and tabs 61*a*, 61*b* is selected to cause a slight bowing out of front panel 35 and back panels 42*a*, 42*b* during the insertion process. This bowing causes a resilient springing back of the front and back panels toward each other, thereby preventing the tabs 61*a*, 61*b* from being easily able to escape from slot 62.

In FIG. 9, panels 53 and 54 have not been folded completely down about retention fold line 33*b* to the final condition as shown in FIG. 1. Such folding can proceed until the panels 53 and 54 are at a slight angle to the back of the cardholder so as to support the cards 22 in a slightly tilted back condition. This makes it easier to remove the cards from the cardholder, and the panels 53 and 54 perform the double function of retaining the free edges of the sheet interlocked by joinder structures 28 and structurally supporting cards 22 when positioned in the cardholder.

It should be noted that the fold along retention fold line 33*b* is one in which the sheet is almost folded back on itself. This can be readily done using the technology of the Related Applications and it makes unfolding of the structure even more difficult, which is, of course, the purpose of the retention structures.

In the embodiment of FIGS. 1-9, joinder structures on the edges 26 and 27 are provided by dovetails. In FIG. 10, free edges 26*a* and 27*a* are joined by L-shaped joinder structures 28*a*. It will be understood, therefore that various other types of interlocking joinder structures are contemplated for use in the present invention. The high precision with which such joinder structures can be folded during relatively complex folding of sheet 23, with fold lines at various angles to achieve the desired shape, makes it possible for very precise registration of the free edges of the sheet.

Figure 11:
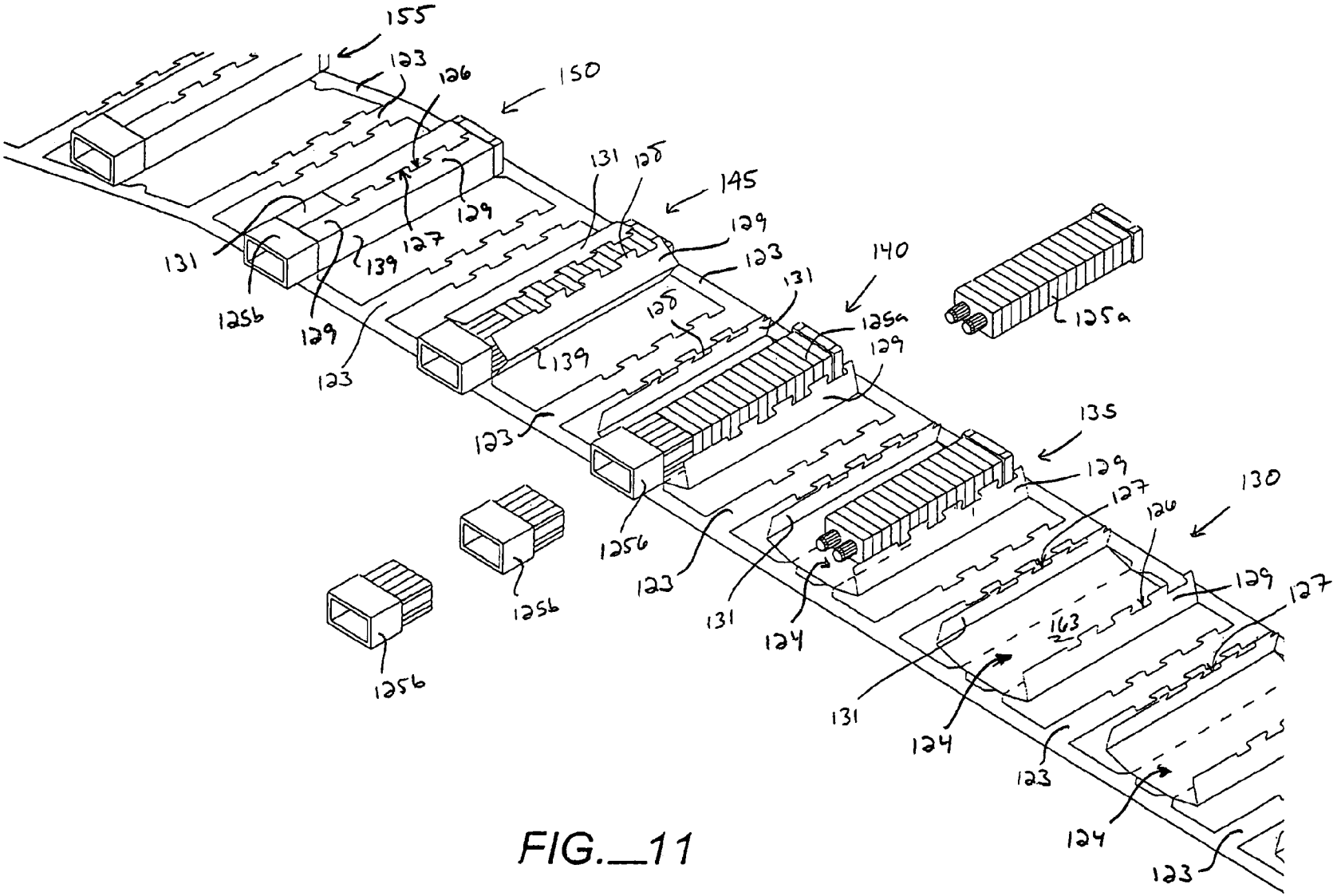
FIG. 11 is a top perspective, schematic representation of an apparatus of the present invention showing the folding of enclosure blanks formed in a strip of sheet material assembled around electrical components.
Figure 12:
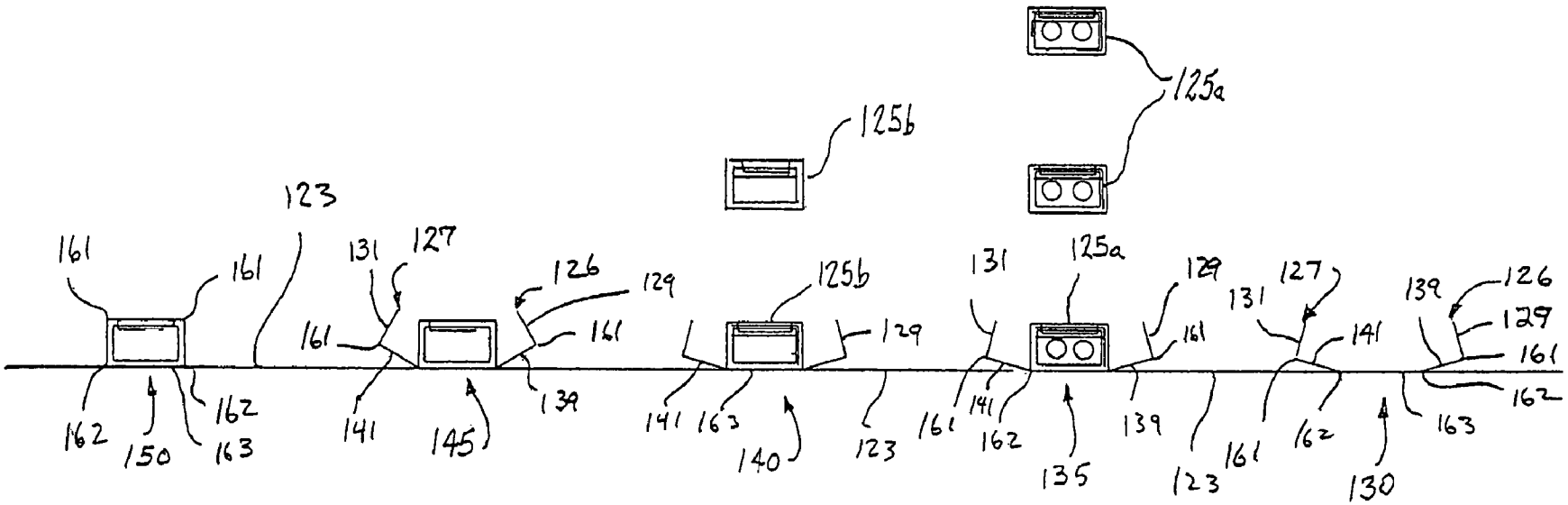
FIG. 12 is a schematic end elevational view of the mounting process shown in FIG. 11 in which components are mounted to a strip of enclosure blanks and the enclosure blanks are folded around the components.

In one embodiment illustrated in FIGS. 11 and 12, another retention structure which is capable of retaining mated joinder structures together against separation. In FIGS. 11 and 12, a plurality of side-by-side enclosure or housing blanks 124 are formed in strip material 123. The enclosures are formed to receive a component or components, such as, electrical components 125*a* and 125*b*, and in the illustrated process, components 125*a*, 125*b* are mounted one after another into the side-by-side enclosure blanks 124 formed in strip 123. The enclosure blanks are further formed for folding after the components are positioned in the blank to complete the enclosure. Edge-joining joinder structures 128 are provided in blanks 124, and the joinder structures are held in interlocked relation by an alternative embodiment of a retention structure. The sequence illustrated is a staged mounting of components to the side-by-side housing blanks and thereafter completion of the component enclosures and removal of the same from the strip.

Referring to FIG. 11 in more detail, therefore, a strip 123 is provided in which a plurality of side-by-side enclosure blanks 124 have been formed, for example, by laser cutting, water jet cutting, stamping, punching, and/or other suitable means. Initially, the blanks 124 would be in a flat condition or all in the same plane. As shown in FIG. 11, edges 126 and 127 of the blanks have been tilted up by about 90 degrees from the plane of sheet 123, and these edges will be seen to be formed with joinder structures 128, which are again illustrated as dovetails. The sheet is schematically illustrated in that it does not include a width dimension for ease of understanding. The upstanding sides 129 and 131 of blanks 124 are positioned for receipt of component 125*a*, 125*b*. A first component portion 125*a* is inserted into the partially formed enclosure blanks 124 at station 135. In the embodiment illustrated, a second component portion 125*b* can be mounted on the end of component 125*a*, while the component blank side walls 129 and 131 are in a near vertical orientation, at station 140. At station 145, side walls 129 and 131 are folded to begin to enclose component 125*a*, 125*b*, and at station 150 the enclosure is completed and dovetails 128 shown in interlocked interengagement. At station 155, the enclosed component 125*a*, 125*b* has been removed from sheet 123.

Again, there is a possible issue of unfolding of the enclosure blank from around component 125*a*, 125*b*, and in the embodiment of FIGS. 11 and 12, retention of interlocking of dovetails 128 has been accomplished in a different manner than for the dovetails 28 of the embodiment of FIGS. 1-9.

FIG. 12 schematically illustrates the manner of retaining joinder structures 128 together that has been employed in the embodiment of FIGS. 11 and 12. As will be seen in FIG. 12, the upstanding side walls 129 and 131 essentially form an L-shaped end cross section with walls 139 and 141, respectively.

The retention structure employed in the embodiment of FIGS. 11 and 12 is a deformation which is here shown as L-shaped corners or bends 161 between enclosure blank walls 129 and 139 and between walls 131 and 141, as shown in FIG. 12. Corners 161 are formed using conventional metal bending techniques; they are not folded or bent using the technology of the Related Applications. Thus, at a station or stage 130, L-shaped bends 161 are formed by a combination of conventional bending dies that will require substantial force to be applied to form bends or corners 161. The result is a bend or corner 161 which will hold its shape against unbending. Enclosure side wall 131 is joined to side wall 141 by a corner that resiliently couples the two side walls together. Small arcuate displacements of side wall 131 relative to side wall 141, therefore, will be resisted by bend 161, and when the displacing force is removed, the side walls will return to the relative angular relationship produced by deforming them to station or stage 130.

The folds or corners 162 between enclosure blank side walls 139 and enclosure blank back wall 163, and between enclosure blank side wall 141 and back wall 163 are made using the technology of the Related Applications. Folds 162, therefore, are much more easily made, and they tend to resiliently spring back or have memory to a much lesser degree than bends 161. Standard or conventional metal bending becomes very difficult as shapes become complex, so it is preferable to minimize the use of reliant folds, such as corners 161, and use folds, such as folds 162, for as many of the enclosure forming folds as possible.

Once component 125*a*, 125*b* is mounted to the enclosure blank at stations 135, 140, folds 162 can be bent into the closed condition shown at stations 145 and 150. The result will be that dovetails 128 will be interlocked, and the conventional bends or deformations of the enclosure blank at folds 161 will act as resilient springs or retention structures that resist unfolding of blanks 124. The angle to which conventional corners or folds 161 are bent can be slightly less than 90 degrees so that a resilient downward biasing of sides 129 and 131 toward component 125*a*, 125*b* is maintained. This will cooperate with folding of the sides 129, 131 into abutting relation against the enclosed electronic component to keep the dovetail joinder structures from opening up or becoming separated.

As will be seen from FIG. 11 and 12, a process for assembly of components into a plurality of enclosures also can be implemented by using the edge joining techniques described above. Moreover, this process allows components to be enclosed using a single sheet of material and without using separate fasteners.

A sheet or strip of sheet material 123 is formed with a plurality of side-by-side enclosure blanks 124. These blanks are preferably attached to a common sheet or strip 123 which can be moved through a plurality of assembly stages, 130, 135, 140, 145, 150 and 155. The enclosure blank as formed with a plurality of shape-controlling folding structures, such as slits, grooves or displacements, and side edges 126 and 127 of the enclosure blank, are formed with joinder structures therein, such as dovetails 128. A retention structure, such as a deformation or conventionally formed fold 161 is formed in blanks 124 at an early assembly station or stage, such as stage 130, to provide a corner or bend that will resiliently return to its bent shape to provide a biasing structure. The process also includes the steps of folding the enclosure blank 124 to produce a partially formed enclosure blank; mounting a component or components in the partially formed enclosure blank; thereafter folding the blank to complete the enclosure and position the dovetail joinder structures in interengagement; and retaining or securing the joinder against separation by, for example, a resilient biasing corner, bend or deformation.

The foregoing description of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application in order to thereby enable others skilled in the art to best utilize the invention and the various embodiments with various modifications as are suited to the particular use contemplated. It is intended that the scope of the invention be defined by the claims appended hereto and their equivalents.

What is claimed is:

1. A sheet of material formed for folding into a three-dimensional structure comprising:

a sheet of material having edges and joinder structures proximate the edges formed to join the edges together;

a plurality of shape-controlling folding structures formed in the sheet of material along a plurality of desired fold lines, the folding structures being positioned to enable folding of the sheet of material into a three-dimensional structure of desired shape, and the shape-controlling folding structures being configured to cause the joinder structures to be positioned together in registration for joining when the sheet of material is folded;

at least one retention structure formed in the sheet of material to retain the joinder structures and edges together, the retention structure being provided by retention folding structures formed for folding of the sheet of material along a retention fold line positioned proximate the free edges producing folding of the sheet of material out of the common plane; and a keeper assembly provided by at least one projection in an edge of the sheet of material and a mating opening dimensioned to receive the projection and oriented to prevent unfolding of the sheet of material along the retention fold lines, wherein the joinder structures are formed in free edges and are adapted to interlock the free edges against separation and are provided by mating dovetail structures in the free edges, the dovetail structures interlocking the edges in a common plane, and wherein the shape-controlling folding structures and the retention folding structures are slits that define a plurality of spaced-apart folding straps having center lines extending obliciuely across the desired retention fold line.

2. The sheet of material as defined in claim 1 wherein, the keeper assembly is provided by a projection on each of two edges of the sheet of material, and the opening is a slot dimensioned to receive the two projections.

3. The sheet of material as defined in claim 1 wherein, the shape-controlling folding structures are formed for sufficiently precise folding of the sheet of material to cause positioning of the joinder structures proximate the free edges to be in precise registration for joinder.

4. The sheet of material as defined in claim 1 wherein, the retention structure is provided by a deformation in the sheet of material inwardly of the joinder structure on one edge, the deformation being formed to resiliently bias the one edge toward the other edge to retain the joinder structures in interlocked relation upon folding of the sheet of material along the shape-controlling folding structures.

5. The sheet of material as defined in claim 4 wherein, the retention structure is provided by a deformation in the sheet of material inwardly of both free edges formed to resiliently bias the joinder structure in both free edges toward interlocked relation.

6. The sheet of material as defined in claim 4 wherein, the retention structure is formed by an L-shaped bend in the sheet of material inwardly of at least one edge.

7. The sheet of material as defined in claim 6 wherein, the L-shaped bend is plastically deformed in the sheet of material using a conventional bending technique.

8. The sheet of material as defined in claim 4 wherein, a plurality of substantially identical side-by-side three-dimensional structures are to be formed from the same sheet of material, with each three-dimensional structure having edges with mating dovetails, shape-controlling folding structures positioned to form an enclosure, and retention structures adapted to retain the dovetails in mating engagement.

9. The sheet of material as defined in claim 8 wherein, each enclosure is configured to receive a component to be mounted in the enclosure, and the dovetails and retention structure join the free edges so that the component is retained in the enclosure.

10. The sheet of material as defined in claim 9 wherein, the retention structure is provided by retention fold structures formed in the sheet of material to produce folding of the sheet of material out of the common plane in which the dovetails are to be joined.

11. The sheet of material as defined in claim 8 wherein, the retention structure is provided by an L-shaped deformation formed to resiliently bias the dovetails into interlocking engagement.

12. The sheet of material as defined in claim 8 wherein, the sheet of material is an elongated strip.

13. A three-dimensional structure comprising the sheet of material of claim 1 folded along the desired fold lines.

14. A method of forming a three-dimensional structure comprising:

folding the sheet of material of claim 9 along the desired fold lines such that at least two edges of the sheet of material are positioned in precise registered juxtaposition for fastening together; and fastening the juxtaposed edges together to prevent unfolding of the sheet of material.

* * * * *